US009505143B2

(12) United States Patent
Wang et al.

(10) Patent No.: US 9,505,143 B2
(45) Date of Patent: Nov. 29, 2016

(54) ONE-STEP GROOVE FORMING DEVICE AND METHOD FOR OBLIQUE CROSSING OF REDUCING PIPE FITTINGS

(71) Applicant: YICHANG TIAN HONG TECHNOLOGY CO., LTD., Yichang (CN)

(72) Inventors: Jinhua Wang, Yichang (CN); Junguo Chen, Yichang (CN)

(73) Assignee: YICHANG TIAN HONG TECHNOLOGY CO., LTD. (CN)

( * ) Notice: Subject to any disclaimer, the term of this patent is extended or adjusted under 35 U.S.C. 154(b) by 337 days.

(21) Appl. No.: 14/351,872

(22) PCT Filed: Mar. 28, 2013

(86) PCT No.: PCT/CN2013/073314

§ 371 (c)(1),
(2) Date: Apr. 14, 2014

(87) PCT Pub. No.: WO2014/040407

PCT Pub. Date: Mar. 20, 2014

(65) Prior Publication Data

US 2014/0352516 A1 Dec. 4, 2014

(30) Foreign Application Priority Data

Sep. 11, 2012 (CN) ..... 2012 1 0332858

(51) Int. Cl.

| | |
|---|---|
| ***B26D 3/00*** | (2006.01) |
| ***B26D 3/06*** | (2006.01) |
| ***B25H 7/04*** | (2006.01) |
| ***B25H 7/00*** | (2006.01) |

(52) U.S. Cl.

CPC ..... *B26D 3/06* (2013.01); *B25H 7/005* (2013.01); *B25H 7/04* (2013.01); *Y10T 83/0304* (2015.04)

(58) Field of Classification Search

CPC ..... B23K 2201/34; B23K 2203/04; B23K 2203/08; B23K 2203/16; B23K 2203/172; B23K 2203/50; B23K 26/0087; B23K 26/0622; B23K 26/364; B23K 26/40; B23K 7/00; B23K 7/006; B23K 7/007

USPC ..... 33/21.3

See application file for complete search history.

(56) References Cited

U.S. PATENT DOCUMENTS

| | | | | |
|---|---|---|---|---|
| 1,991,117 A * | 2/1935 | Porteous | B25H 7/005 | 266/54 |
| 3,835,541 A * | 9/1974 | Whitworth | B25H 7/005 | 266/54 |
| 3,856,283 A * | 12/1974 | Johnson | B23K 7/10 | 148/201 |
| 4,243,868 A * | 1/1981 | Graham | B23K 9/0286 | 219/125.11 |

(Continued)

*Primary Examiner* — Yaritza Guadalupe-McCall
(74) *Attorney, Agent, or Firm* — Wiersch IP Law

(57) ABSTRACT

The present invention discloses a one-step groove forming device and method for oblique crossing of reducing pipe fittings. The forming device is composed of a plurality of clamping components (1) and at least one marking component (2), the clamping components (1) are movably connected and can be fixedly connected, and at least one clamp (3) is arranged on the clamping component (1); the marking component (2) comprises a probe (4) and a marking knife (5) fixed on the probe, one end of the probe (4) is provided with a pinhead (6), and the marking component (2) is used in concert with the plurality of clamping components (1). The forming device of the present invention can realize one-step groove forming for oblique crossing of pipe fittings with different diameters at any angle.

2 Claims, 5 Drawing Sheets

(56) References Cited

U.S. PATENT DOCUMENTS 4,392,644 A * 7/1983 Borzym ..... B23D 21/00 269/157
4,437,374 A * 3/1984 Borzym ..... B23D 21/00 269/234
4,445,677 A * 5/1984 Hansen ..... B29C 66/81 100/283
4,470,291 A * 9/1984 Gibb ..... B21D 17/02 269/289 MR
4,553,305 A * 11/1985 Dearman ..... B23K 37/0533 228/49.3
4,793,066 A * 12/1988 Cheng ..... B25H 7/005 33/21.3
8,397,975 B1 * 3/2013 Franco ..... B23K 37/0533 228/212
8,615,863 B1 * 12/2013 Hope ..... B25B 27/10 29/255
2014/0352516 A1 * 12/2014 Wang ..... B25H 7/04 83/875

* cited by examiner

ONE-STEP GROOVE FORMING DEVICE AND METHOD FOR OBLIQUE CROSSING OF REDUCING PIPE FITTINGS

FIELD

The present invention relates to a reducing pipe fitting joint device, in particular to a one-step groove forming device for oblique crossing of reducing pipe fittings and a cutting method.

BACKGROUND

When primary and secondary pipes with different diameters are obliquely crossed and butt-jointed at any angle in the butt-joint process of reducing pipe fittings, the contact surface between the primary pipe and the secondary pipe is an irregular curved surface, leading to high difficulty in onsite mapping and processing; an experience-based layout method is typically employed in practical production, however, multiple processing needs to be carried out before progressive attached forming is reached, which is accordingly against fast production.

SUMMARY

An object of the present invention is to provide a one-step groove forming device and method for oblique crossing of pipe fittings with different diameters at any angle.

The aforementioned object of the present invention is reached as below: the one-step groove forming device for oblique crossing of reducing pipe fittings is composed of a plurality of clamping components and at least one marking component, the clamping components are movably connected and can be moved relatively by taking the connection location as center, the connection location can be fastened to fix the positions of the clamping components, and at least one clamp is arranged on the clamping component; the marking component comprises a probe and a marking knife fixed on the probe, one end of the probe is provided with a pinhead, and the marking component is used in concert with the plurality of clamping components.

Further, a dial is arranged on the location where the clamping components are movably connected.

Further, the clamp comprises two clamping parts and a base, the two clamping parts are fixed on the base, and the two clamping parts are relatively movable in a back-and-forth manner.

Further, the clamp comprises two fasteners, the fastener is composed of two semi-rings, one end of the semi-ring is movably fixed on the clamping component and the other end is provided with a plurality of screw holes, and the ends of the two semi-rings, which are not fixed on the clamping components, can be fixedly connected by threading bolts through the screw holes.

Further, there are two clamping components, and one clamp is arranged on the clamping component.

Further, there are three clamping components, and one clamp is arranged on the clamping component.

Further, there are three clamping components, and two clamps are arranged on one of the clamping components.

A method for groove cutting by the one-step groove forming device for oblique crossing of reducing pipe fittings comprises the following steps: in the first step, a primary pipe fitting is clamped using the clamp on one clamping component; in the second step, a secondary pipe fitting is clamped using the clamp on the other clamping component; in the third step, the clamping component for clamping the secondary pipe fitting is rotated, enabling the positional relationship between the primary pipe fitting and the secondary pipe fitting to be that connection between the primary pipe fitting and the secondary pipe fitting is required; in the fourth step, the location where the clamping component for clamping the primary pipe fitting and the clamping component for clamping the secondary pipe fitting are connected is fastened, so that the two clamping components are relatively fixed in position and the included angle between the two clamping components is an included angle when connection between the primary pipe fitting and the secondary pipe fitting is required; in the fifth step, the probe is attached to the outer wall of the secondary pipe fitting with a hand or a machine, the pinhead of the probe comes into contact with the outer wall of the primary pipe fitting, the probe is parallel with the axis of the secondary pipe fitting, and the tip of the marking knife comes into contact with the outer wall of the secondary pipe fitting and is parallel with the axis of the primary pipe fitting; and in the sixth step, while the probe is rotated around the axis of the secondary pipe fitting in a radial direction, the pinhead leaves a motion track on the outer wall of the primary pipe fitting, the tip of the marking knife leaves a motion track on the outer wall of the secondary pipe fitting, and the motion track on the outer wall of the primary pipe fitting and the motion track on the outer wall of the secondary pipe fitting are the same, thus the groove for oblique crossing of the primary pipe fitting and the secondary pipe fitting can be achieved.

Further, when the pinhead and/or the tip of the marking knife fails to cut the pipe fittings, a cutting device may be used for cutting the pipe fittings in accordance with the tracks, thus the groove for oblique crossing of the primary pipe fitting and/or the secondary pipe fitting is achieved as well.

The present invention has the advantages that: the clamping components in the one-step groove forming device for oblique crossing of reducing pipe fittings are movably connected and can be moved relatively by taking the connection location as center, the connection location can be fastened to fix the position of the clamping components, and at least one clamp is arranged on the clamping component; when the secondary pipe fitting is connected to the primary pipe fitting, the clamp on one clamping component is used for fixing the primary pipe fitting at first, and then, the clamp on the other clamping component is used for fixing the secondary pipe fitting; afterwards, the angle between the clamping components is adjusted according to a desired angle in construction, enabling the primary and secondary pipe fittings to be arranged according to a positional relationship for connection thereof; the connection location of the clamping components is fastened to make the positional relationship between the clamping components unchanged; the probe is attached to the outer wall of the secondary pipe fitting with a hand or other device, the pinhead of the probe comes into contact with the outer wall of the primary pipe fitting, the probe is parallel with the axis of the secondary pipe fitting, and the tip of the marking knife comes into contact with the outer wall of the secondary pipe fitting and is parallel with the axis of the primary pipe fitting; while the probe is rotated around the axis of the secondary pipe fitting in a radial direction, the pinhead leaves a motion track on the outer wall of the primary pipe fitting, the tip of the marking knife leaves a motion track on the outer wall of the secondary pipe fitting, and the motion track on the outer wall of the primary pipe fitting and the motion track on the outer wall of the secondary pipe fitting are the same, thus the groove for oblique crossing of the primary pipe fitting and the secondary pipe fitting can be achieved; when the pinhead and/or the tip of the marking knife fails to cut the pipe fittings, a cutting device may be used for cutting the pipe fittings in accordance with the tracks, thus the groove for oblique crossing of the primary pipe fitting and/or the secondary pipe fitting is achieved as well; a dial is arranged on the location where the clamping components are movably connected, the clamp comprises two clamping parts and a base, the two clamping parts are fixed on the base, and the two clamping parts are relatively movable in a back-and-forth manner; as a result, the one-step groove forming device for oblique crossing of reducing pipe fittings is more convenient to use.

There are three clamping components, and one clamp is arranged on the clamping component; or there are three clamping components, and two clamps are arranged on one of the clamping components; a plurality of grooves for connection of two secondary pipe fittings with one primary pipe fitting may be processed in one step, and a plurality of grooves for connection of two secondary pipe fittings and two primary pipe fittings may also be processed.

BRIEF DESCRIPTION OF THE DRAWINGS

The present invention will be further illustrated below in conjunction with the accompanying drawings and embodiments.

DETAILED DESCRIPTION

Figure 1:
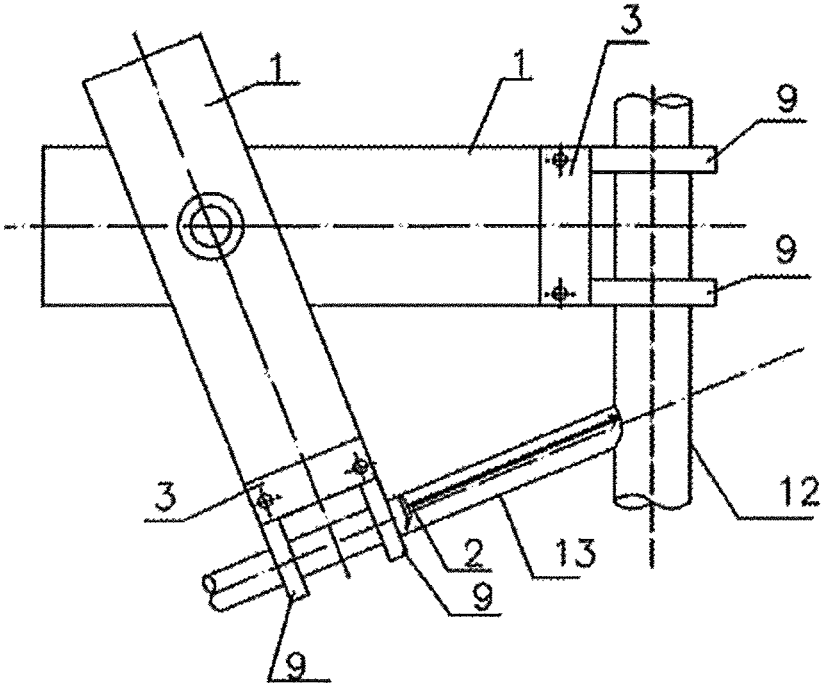
FIG. 1 is a structural view of one embodiment in the present invention.
Figure 3:
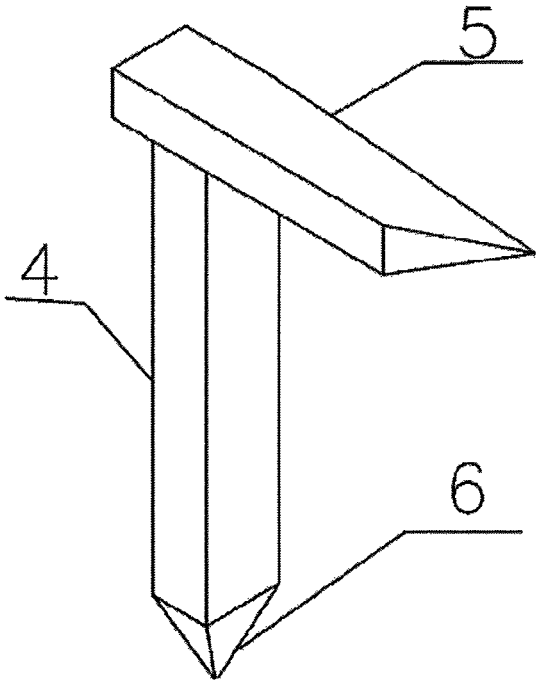
FIG. 3 is a structural view of the marking component in the present invention.
Figure 4:
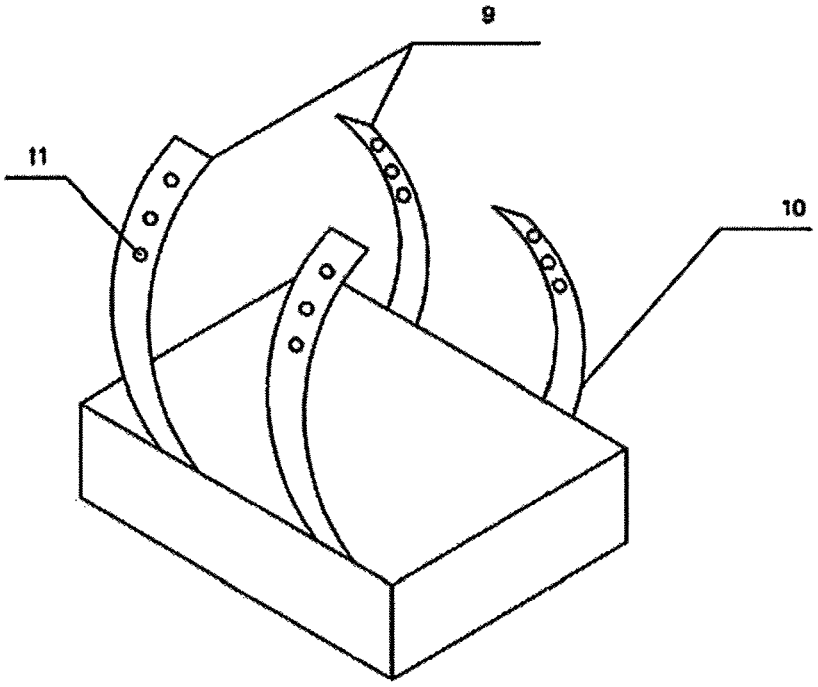
FIG. 4 is a structural view of one embodiment of the clamp in the present invention.

As shown in FIG. 1, FIG. 3 and FIG. 4, the one-step groove forming device for oblique crossing of reducing pipe fittings is composed of two clamping components 1 and at least one marking component 2, the clamping components 1 are connected through bolts and are relatively moved by taking the bolts as center, the position of the clamping components is fastened by nuts, a clamp 3 is arranged on the clamping component 1, the clamp 3 comprises two fasteners 9, the fastener 9 is composed of two semi-rings 10, one end of the semi-ring 10 is movably fixed on the clamping component 1 and the other end is provided with a plurality of screw holes 11, and the ends of the two semi-rings 10, which are not fixed on the clamping components 1, can be fixedly connected by threading bolts through the screw holes 11; the marking component 2 comprises a probe 4 and a marking knife 5 fixed on the probe 4, one end of the probe 4 is provided with a pinhead 6, and a primary pipe fitting 12 and a secondary pipe fitting 13 are fixed on the clamps 3, respectively.

Figure 2:
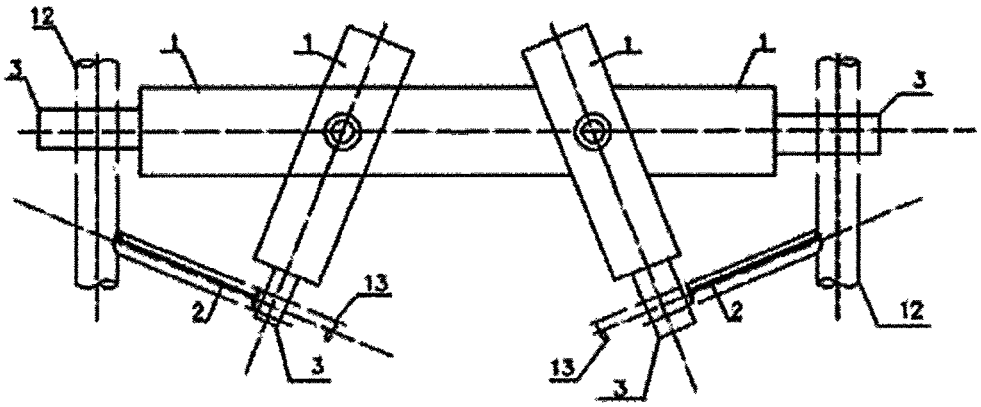
FIG. 2 is a structural view of another embodiment in the present invention.
Figure 5:
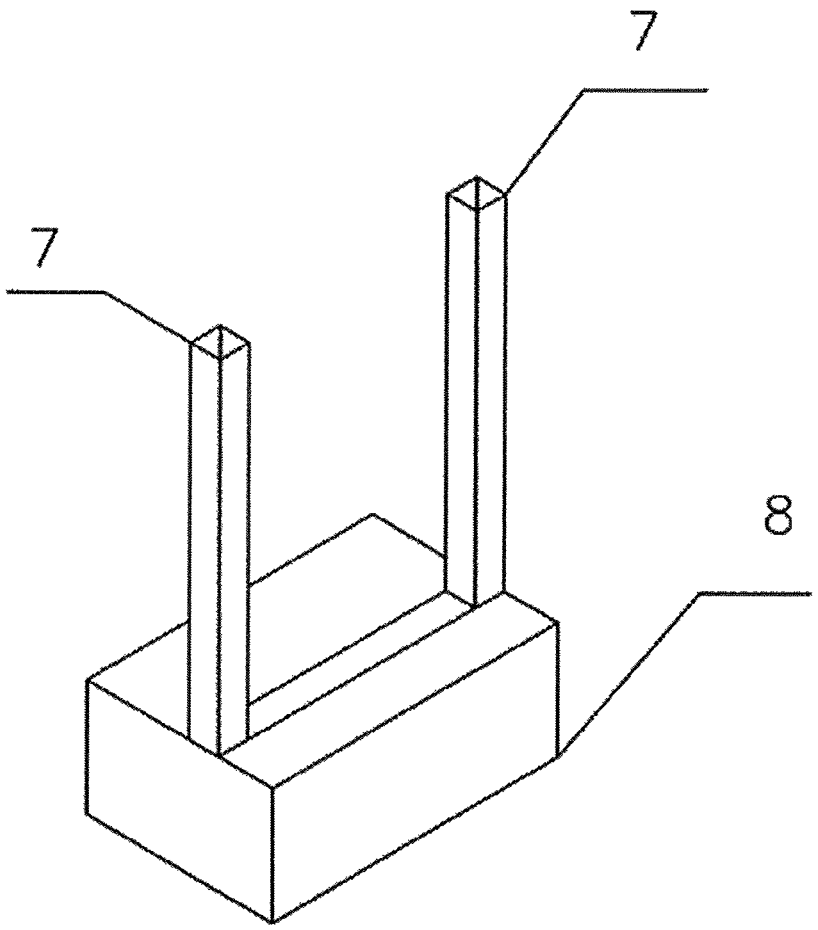
FIG. 5 is a structural view of another embodiment of the clamp in the present invention.

As shown in FIG. 2, FIG. 3 and FIG. 5, the one-step groove forming device for oblique crossing of reducing pipe fittings is composed of three clamping components 1 and two marking components 2, the clamping components 1 are connected through bolts and are relatively moved by taking the bolts as center, the position of the clamping components is fastened by nuts, two clamps 3 are arranged on one of the clamping components 1, one clamp 3 is arranged on each of the other two clamping components 1; the clamp comprises two clamping parts 7 and a base 8, the two clamping parts 7 are fixed on the base 8, and the clamping parts 7 are relatively movable in a back-and-forth manner; the marking component 2 comprises a probe 4 and a marking knife 5 fixed on the probe 4, one end of the probe 4 is provided with a pinhead 6; and a primary pipe fitting 12 and a secondary pipe fitting 13 are fixed on the clamps 3, respectively.

The working principle of the device is as follows: the first embodiment: during use, the primary pipe fitting 12 is disposed on the clamp 3 on one clamping component 1 at first, and then fastened by threading the bolts through the corresponding screw holes 11 between the two semi-rings 10; the secondary pipe fitting 13 is disposed on the clamp 3 on the other clamping component 1 and then fastened by threading the bolts through the corresponding screw holes 11 between the two semi-rings 10; then, the included angle between the two clamping components 1 is adjusted according to the positional relationship for connection between the primary pipe fitting 12 and the secondary pipe fitting 13, the bolts are fastened by the nuts; the probe 4 is attached to the outer wall of the secondary pipe fitting 13 with a hand or other device, the pinhead 6 of the probe 4 comes into contact with the outer wall of the primary pipe fitting 12, the probe 4 is parallel with the axis of the secondary pipe fitting 13, and the tip of the marking knife 5 comes into contact with the outer wall of the secondary pipe fitting 13 and is parallel with the axis of the primary pipe fitting 12; while the probe 4 is rotated around the axis of the secondary pipe fitting 13 in a radial direction, the pinhead 6 leaves a motion track on the outer wall of the primary pipe fitting 12, the tip of the marking knife 5 leaves a motion track on the outer wall of the secondary pipe fitting 13, and the motion track on the outer wall of the primary pipe fitting 12 and the motion track on the outer wall of the secondary pipe fitting 13 are the same, thus the groove for oblique crossing of the primary pipe fitting 12 and the secondary pipe fitting 13 can be achieved; when the pinhead 6 and/or the tip of the marking knife 5 fails to cut the pipe fittings, a cutting device may be used for cutting the pipe fittings in accordance with the tracks, thus the groove for oblique crossing of the primary pipe fitting 12 and/or the secondary pipe fitting 13 is achieved as well.

The second embodiment: during use, the two primary pipe fittings 12 are disposed on the two clamps 3 on one clamping component 1 respectively at first, and then clamped after the two clamping parts 7 are relatively moved and fastened; the two secondary pipe fittings 13 are disposed on the clamps 3 on the other two clamping components 1 respectively and then clamped after the two clamping parts 7 are relatively moved and fastened; then, the included angle between the clamping components 1 is adjusted according to the positional relationship for connection between the two primary pipe fittings 12 and the two secondary pipe fittings 13, and the bolts are fastened by the nuts; the probe 4 is attached to the outer wall of the secondary pipe fitting 13 with a hand or other device, the pinhead 6 of the probe 4 comes into contact with the outer wall of the primary pipe fitting 12, the probe 4 is parallel with the axis of the secondary pipe fitting 13, and the tip of the marking knife 5 comes into contact with the outer wall of the secondary pipe fitting 13 and is parallel with the axis of the primary pipe fitting 12; while the probe 4 is rotated around the axis of the secondary pipe fitting 13 in a radial direction, the pinhead 6 leaves a motion track on the outer wall of the primary pipe fitting 12, the tip of the marking knife 5 leaves a motion track on the outer wall of the secondary pipe fitting 13, and the motion track on the outer wall of the primary pipe fitting 12 and the motion track on the outer wall of the secondary pipe fitting 13 are the same, thus the groove for oblique crossing of the primary pipe fitting 12 and the secondary pipe fitting 13 can be achieved; when the pinhead 6 and/or the tip of the marking knife 5 fails to cut the pipe fittings, a cutting device may be used for cutting the pipe fittings in accordance with the tracks, thus the groove for oblique crossing of the primary pipe fitting 12 and/or the secondary pipe fitting 13 is achieved as well.

The clamp 3 comprises two clamping parts 7 and a base 8, the two clamping parts 7 are fixed on the base 8, and the spacing between the two clamping parts 7 may be adjusted, therefore, pipe fittings with different diameters may be clamped.

The clamp 3 comprises two fasteners 9, the fastener is composed of two semi-rings 10, one end of the semi-ring 10 is movably fixed on the clamping component 1 and the other end is provided with a plurality of screw holes 11, and the ends of the two semi-rings 10, which are not fixed on the clamping components 1, can be fixedly connected by threading bolts through the screw holes 11; the two semi-rings 10 may be fastened by threading the bolts through the corresponding screw holes 11 on the basis of pipe fittings with different diameters.

The present invention is applicable to a variety of pipe fittings made of different materials (iron, aluminum, copper, plastic, etc.), and the grooves of a plurality of joints may also be processed at the same time by adjusting the quantity of the clamping components 1 or the clamps 3.

INDUSTRIAL APPLICABILITY

The present invention has the advantages that: the clamping components in the one-step groove forming device for oblique crossing of reducing pipe fittings are movably connected and can be moved relatively by taking the connection location as center, the connection location can be fastened to fix the position of the clamping components, and at least one clamp is arranged on the clamping component; when the secondary pipe fitting is connected to the primary pipe fitting, the clamp on one clamping component is used for fixing the primary pipe fitting at first, and then, the clamp on the other clamping component is used for fixing the secondary pipe fitting; afterwards, the angle between the clamping components is adjusted according to a desired angle in construction, enabling the primary and secondary pipe fittings to be arranged according to a positional relationship for connection thereof; the connection location of the clamping components is fastened to make the positional relationship between the clamping components unchanged; the probe is attached to the outer wall of the secondary pipe fitting with a hand or other device, the pinhead of the probe comes into contact with the outer wall of the primary pipe fitting, the probe is parallel with the axis of the secondary pipe fitting, and the tip of the marking knife comes into contact with the outer wall of the secondary pipe fitting and is parallel with the axis of the primary pipe fitting; while the probe is rotated around the axis of the secondary pipe fitting in a radial direction, the pinhead leaves a motion track on the outer wall of the primary pipe fitting, the tip of the marking knife leaves a motion track on the outer wall of the secondary pipe fitting, and the motion track on the outer wall of the primary pipe fitting and the motion track on the outer wall of the secondary pipe fitting are the same, thus the groove for oblique crossing of the primary pipe fitting and the secondary pipe fitting can be achieved; when the pinhead and/or the tip of the marking knife fails to cut the pipe fittings, a cutting device may be used for cutting the pipe fittings in accordance with the tracks, thus the groove for oblique crossing of the primary pipe fitting and/or the secondary pipe fitting is achieved as well; a dial is arranged on the location where the clamping components are movably connected, the clamp comprises two clamping parts and a base, the two clamping parts are fixed on the base, and the two clamping parts are relatively movable in a back-and-forth manner; as a result, the one-step groove forming device for oblique crossing of reducing pipe fittings is more convenient to use.

What is claimed is:

1. A method for groove cutting by a one-step groove forming device for oblique, crossing of reducing pipe fittings, the one-step groove forming device comprising:

a plurality of clamping components (1); and at least one marking component (2), wherein, the clamping components (1) are movably connected and is fixedly connected, at least one clamp (3) is arranged on the clamping component (1);

the marking component (2) a probe (4) and a marking knife (5) fixed on the probe (4), one end of the probe (4) is provided with a pinhead (6), and the marking component (2) is used in concert with the plurality of damping components (1), wherein, in the first step, a primary pipe fitting (12) is clamped using the clamp (3) on one clamping component (1);

in the second step, a secondary pipe fitting (13) is clamped using the clamp (3) on the other clamping component (1);

in the third step, the clamping component (1) for damping the secondary pipe fitting (13) is rotated, enabling the positional relationship between the primary pipe fitting (12) and the secondary pipe fitting (13) to be that connection between the primary pipe fitting (12) and the secondary pipe fitting (13) is required;

in the fourth step, the location where the clamping component (1) for clamping the primary pipe fitting (12) and the clamping component (1) for clamping the secondary pipe fitting (13) are connected is fastened, so that the two clamping components (1) are relatively fixed in position and an included angle between the two clamping components (1) is an included angle when connection between the primary pipe fitting (12) and the secondary pipe fitting (13) is required;

in the fifth step, the probe (4) is attached to the outer will of the secondary pipe fitting (13) with a hand or a machine, the pinhead (6) of the probe (4) comes into contact with the outer wall of the primary pipe fitting (12), the probe (4) is parallel with an axis of the secondary pipe fitting (13), and the tip of the marking knife (5) comes into contact with the outer wall of the secondary pipe fitting (13) and is parallel with an axis of the primary pipe fitting (12); and in the sixth step, while the probe (4) is rotated around the axis of the secondary pipe fitting (13) in a radial direction, the pinhead (6) leaves a motion track on the outer wall of the primary pipe fitting (12), the tip of the marking knife (5) leaves a motion track on the outer wall of the secondary pipe fitting (13), and the motion track on the outer wall of the primary pipe fitting (12) and the motion track on the outer wall of the secondary pipe fitting (13) are the same, and an groove for oblique crossing of the primary pipe fitting (12) and the secondary pipe fitting (13) is achieved.

2. The method for groove cutting by the one-step groove forming device for oblique crossing of reducing pipe fittings according to claim 1, wherein, when the pinhead (6) and/or the tip of the marking knife (5) fails to cut the pipe fittings, a cutting device may be used for cutting the pipe fittings in accordance with the tracks, so that groove for oblique crossing of the primary pipe fitting (12) and/or the secondary pipe fitting (13) is achieved.

* * * * *